United States Patent [19]

Blitzer et al.

[11] 4,302,283

[45] Nov. 24, 1981

[54] SIZING PROCESS AND COMPOSITION

[75] Inventors: Sidney M. Blitzer, Baton Rouge, La.; Harry D. Wilder, Midlothian, Va.

[73] Assignee: Ethyl Corporation, Richmond, Va.

[21] Appl. No.: 183,439

[22] Filed: Sep. 2, 1980

Related U.S. Application Data

[63] Continuation of Ser. No. 869,694, Jan. 16, 1978, abandoned, which is a continuation of Ser. No. 490,273, Jul. 22, 1974, abandoned.

[51] Int. Cl.[3] ..... D21H 3/08

[52] U.S. Cl. ..... 162/158; 162/180

[58] Field of Search ..... 162/158, 179, 180; 562/590

[56] References Cited

U.S. PATENT DOCUMENTS 3,139,373 6/1964 Liggett ..... 162/158

3,821,069 6/1974 Wurzburg ..... 162/158

*Primary Examiner*—Peter Chin

*Attorney, Agent, or Firm*—Donald L. Johnson; John F. Sieberth; Paul H. Leonard

[57] ABSTRACT

Improved paper sizing is obtained by using water soluble salts of substitutes succinic acid having the formula:

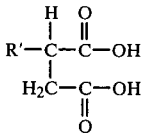

wherein R′ is essentially hydrocarbon group of the formula

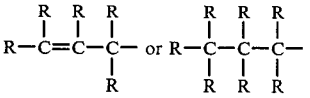

wherein R is hydrogen or alkyl, at least two R groups being alkyl, and the total number of carbon atoms in R′ is from 16 to about 26.

16 Claims, No Drawings

SIZING PROCESS AND COMPOSITION

This is a continuation of application Ser. No. 869,694 filed on Jan. 16, 1978, abandoned which in turn is a continuation of application Ser. No. 490,273, filed on July 22, 1974, abandoned.

BACKGROUND OF THE INVENTION

Field of the Invention

This invention relates to the production of paper and in particular to the sizing of paper using as a sizing agent water soluble salt of substituted succinic acid. The invention also relates to novel compositions of matter containing paper which has been sized using sizing agents of the present invention.

Numerous materials have been used in the past for sizing paper. Sizing using salt of certain substituted succinic anhydrides or acids is disclosed in U.S. Pat. No. 3,139,373. Sizing agents of that patent are substituted with hydrocarbon radicals having from 8 to 15, especially 10–14, carbon atoms. The patent discloses that agents whose substituent hydrocarbons radicals contain less than 8 carbon atoms or more than 15 carbon atoms give unsatisfactory results. The only substituent hydrocarbon radical having more than 15 carbon atoms disclosed in the patent is the n-octadecenyl radical of n-octadecenylsuccinic anhydride. From the examples and the claims, it appears that the patent shows a preference for normal dodecenyl substitution. In the process of U.S. Pat. No. 3,139,373, the substituted alkenyl succinic acid or anhydride is saponified with an alkaline material to form a soluble salt, which is combined with aqueous paper-pulp slurry. The resulting mixture is treated with a precipitating agent such as an aluminum salt to convert the soluble salt into an insoluble form which deposits on the pulp fibers.

Paper sizing using substituted succinic anhydrides is disclosed in U.S. Pat. No. 3,102,064. Although the patent indicates that the anhydride can be used in various ways, it appears that a preferred method of use is to form a starch emulsion of the anhydride as a working system. Unfortunately such starch-anhydride systems have a short useful "life" and must be used promptly after the preparation thereof. This necessitates not only special equipment for the preparation of the emulsions but also limits the effectiveness of recirculation of white water in paper mills that use such a recirculation technique.

SUMMARY OF THE INVENTION

The present invention provides an improved process for the internal sizing of paper utilizing water soluble salts of hydrocarbon substituted succinic acids wherein the hydrocarbon substitution is essentially secondary alkyl or alkenyl group having from 16 to about 26 carbon atoms per molecule. The sizing agent of the present process is not subject to the problem of short useful life of the working system and hence is readily and conveniently usable in a paper mill that employs recirculation of the white water. The sizing agents of the present invention can be combined with the paper stock slurry either prior to or after contacting the slurry with alum or recirculated white water, or reworked paper or other systems containing a precipitating agent.

It is evident therefore that the present invention provides an improvement in the process for the internal sizing of paper wherein an aqueous suspension of paper pulp is admixed with sizing agent and precipitating agent to set the sizing agent on the fiber and the mass is formed into a sheet. The improvement comprises incorporating as a sizing agent, water soluble salt of substituted succinic acid having the formula

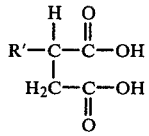

wherein R′ is essentially hydrocarbon group of the formula

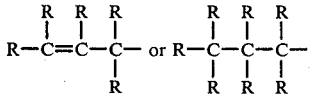

wherein R is hydrogen or alkyl, at least two R groups being alkyl, and the total number of carbon atoms in R′ is from 16 to about 26.

Preferably, the salt is a mixture of salts having at least two different numbers of carbon atoms per molecule, there being present in the mixture at least 10 percent of salt of each of two different numbers of carbon atoms per molecule.

Preferably the salt is alkali metal salt, especially sodium salt.

Preferably the water soluble salt of substituted succinic acid is produced by saponifying the corresponding substituted succinic anhydride with alkali metal hydroxide, typically sodium hydroxide or potassium hydroxide, especially the former. Preferably alkyl groups of R are essentially straight chain groups.

Precipitating agents useful for the present invention are, generally speaking, any suitable composition or combination of materials that produces sizing when combined with the substituted succinic acid salts of the present invention as described herein. Preferred precipitating agents are compounds which react with the substituted succinic acid salts of the present invention to form a substituted succinic acid salt precipitate which deposits upon the paper pulp and also forms a soluble sodium salt with the alkali metal of the substituted succinic acid salt sizing agent. Especially preferred precipitation agent salt sizing agent. Especially preferred precipitation agent is papermaker's alum, which is usually obtained at moderate cost in the hydrated form $Al_2(SO_4)_3.18\ H_2O$, on which basis the alum percentages set forth herein have been calculated. Other precipitating agents are aluminum chloride, and sodium aluminate. The suitability of various precipitating agents is readily determined by routine experimentation following the procedures given herein.

Preferably the pH of said mass is from about 4 to about 6. The desired pH typically is obtained by the addition of a mineral acid, such as HCl or $H_2SO_4$ to a system having a higher pH. Since the precipitating agents generally and alum specifically are acidic in nature, the pH adjustment may be accomplished in some instances by the addition of alum alone, particularly when the water is only slightly basic or neutral. Where the water is significantly basic, for example, the Baton Rouge, La., well water used in some of the Examples herein, it is generally preferred to use mineral acid such as the HCl or $H_2SO_4$ typified in the foregoing to assist in the pH control otherwise the amount of alum required for that purpose may be greater than the amount suitable for sizing economies as permitted by the use of the sizing agents of the present invention.

The invention also relates to sized paper comprising a fibrous cellulosic web which has been internally sized with salt of substituted succinic acid having the formula

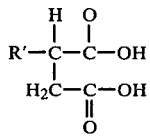

wherein R is essentially hydrocarbon group of the formula

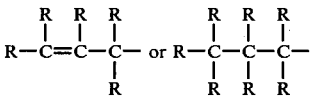

wherein R is hydrogen or alkyl, at least two R groups being alkyl, and the total number of carbon atoms in R′ is from 16 to about 26. Preferably the salt is alkali metal salt, especially sodium. Preferably alkyl groups of R are essentially straight chain groups.

In another aspect, the present invention relates to the method of sizing paper which comprises the step of intimately dispersing within the wet pulp prior to the ultimate conversion of said pulp into a dry web as a sizing agent an effective amount of a system of alum plus alkali metal salt of substituted dicarboxylic acid corresponding to the structural formula

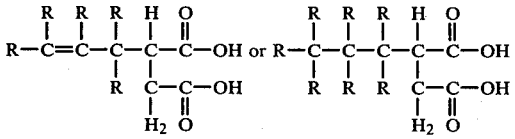

wherein R is hydrogen or alkyl, at least two R groups being alkyl, and the total number of carbon atoms in the salt is from 20 to about 30. Preferably the salt is alkali metal salt, especially sodium salt. Preferably alkyl groups of R are essentially straight chain groups.

In another preferred aspect, the invention provides a process for the internal sizing of paper wherein an aqueous suspension of paper pulp is admixed with sizing agent and precipitating agent to set the sizing agent on the fiber and the mass is formed into a sheet. The improvement comprises incorporating as sizing agent, rosin size and water soluble salt of substituted succinic acid having the formula

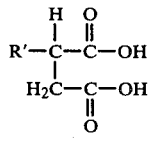

wherein R′ is essentially hydrocarbon group of the formula

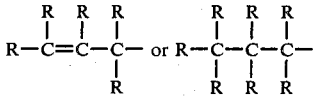

wherein R is hydrogen or alkyl, at least two R groups being alkyl, and the total number of carbon atoms in R′ is from 16 to about 26, the weight ratio of rosin size to said salt being from about 10:1 to about 1:10. Preferably the salt is alkali metal salt, especially sodium. Preferably alkyl groups of R are essentially straight chain groups. Preferred precipitating agent is alum.

In a preferred aspect, the invention provides a method of sizing paper which comprises the step of intimately dispersing within the wet pulp prior to the ultimate conversion of said pulp into a dry web a mixture of alum, rosin size and alkali metal salt of substituted dicarboxylic acid corresponding to the structural formula

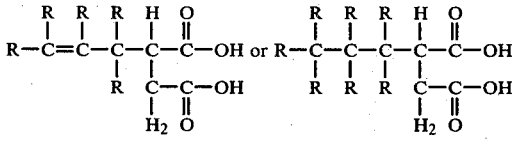

wherein R is hydrogen or alkyl, at least two R groups being alkyl, and the total number of carbon atoms in the salt is from 20 to about 30, the weight ratio of rosin size to said salt being from about 0.1 to about 10, the weight ratio of rosin size plus said salt to alum being from about 0.02 to about 1.0. Preferably the salt is alkali metal salt, especially sodium. Preferably, alkyl groups of R are essentially straight chain hydrocarbon groups.

In a preferred aspect, the invention provides a process for the internal sizing of paper wherein an aqueous suspension of paper pulp is admixed with filler, with sizing agent and with precipitating agent to set the sizing agent on the fiber and the resulting mass is formed into a sheet. The improvement comprises incorporating as sizing agent, water soluble salt of substituted succinic acid having the formula

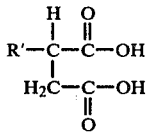

wherein R′ is essentially hydrocarbon group of the formula

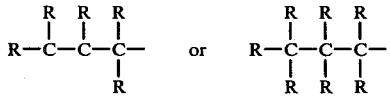

wherein R is hydrogen or alkyl, at least two R groups being alkyl, and the total number of carbon atoms in R′ is from 16 to about 26.

Preferably the filler is titanium dioxide, clay, or a mixture of the two. Preferably the salt is alkali metal salt, especially sodium. Preferably alkyl groups of R are essentially straight chain groups. Preferably the precipitating agent is alum. Titanium dioxide is a preferred filler.

DESCRIPTION

The manufacture of paper is a highly developed art which uses equipment and technology that has been developed to a highly perfected state over a period of many years. Nevertheless, there are problem areas and a need for further improvements. One problem area is that of sizing. A large proportion of the paper and paperboard that is produced is "sized"; i.e., it is treated to provide resistance to penetration by liquids, especially water. Usually the sizing is performed during the paper manufacture in conjunction with the incorporation of other materials such as pigments, dyes or fillers such as titanium dioxide or clay which impart other desired properties such as color, opacity, brightness, etc.

Numerous combinations of sizing agent, precipitating agent for the sizing agent and fillers have been used in the past. The present invention provides a new sizing agent with improved properties and which has certain synergism in combination with other sizing agents, precipitating agents, and fillers. Furthermore, the new sizing agents are compatible with existing papermaking processes and are suitable for incorporation directly into the conventional papermaking processes without requiring significant alterations or special provisions for use.

The novel sizing agents of the present invention are preferably used in admixture with alum. Such mixed systems are useful alone or in combination with other conventional sizing agents and precipitating agents such as conventional rosin size and with or without fillers as desired, with or without other conventional papermaking additives such as starch, amines, amide polymers, or the like.

One of the important aspects of the present invention is that it provides a way to materially reduce, and even to eliminate entirely in many instances, the dependency upon natural source rosin for sizing paper. Since paper sizing is the largest single use of rosin and nearly 40 percent of the rosin produced in the United States is used in the sizing of paper, the magnitude of the savings of natural source rosin provided by reducing the consumption of rosin used in the sizing of paper by even 25 percent is of vast proportions. Coupled with this, the present invention makes the paper industry far less dependent upon supply and demand factors of the rosin industry such as weather and politics and permits the employment of forestry practices which are geared to the production of timber rather than of rosin plus timber.

Where rosin is used in combination with the present substituted succinic acid salts in the practice of the present invention, any suitable form of rosin may be used. Preferred rosin is the form well known to the industry as fortified rosin which is produced and used as set forth in Kirk-Othmer Encyclopedia of Chemical Technology, 2nd Edition, Vol. 17, 1968, pages 475–508. Various rosins are gum rosin, dark or pale rosins recovered from pine stumps and rosin from tall oil from the kraft pulping process. Preferred fortified rosin is obtained by a reaction of rosin acids with maleic anhydride followed by at least a partial hydrolysis or neutralization with a basic material such as a hydroxide or oxide of an alkali or alkaline earth metal, preferably sodium hydroxide. Numerous fortified rosins are produced and used in a large scale. Several trade names for rosins currently available and their source are Cyfor, American Cyanamid; Mersize, Monsanto; and Pexol, Hercules.

The sizing agents of the present invention are preferably produced by reacting olefin and maleic anhydride according to known processes as described, for example, in Revue. Prod. Chim., 65, p. 57–64, p. 117–125 (1962) and in U.S. Pat. No. 3,476,774. Following the reaction of olefin and maleic anhydride, the product is preferably heated under vacuum to remove residual reactants and then is converted to a salt by reaction with a suitable basic material such as sodium hydroxide. The salts thus obtained may be fully salified; i.e. having two metal cation equivalents, e.g. 2 $Na+$, per molecule of divalent substituted succinate organic anion or they can be partly salified; i.e. with less than two metal cation equivalents per molecule of divalent organic anion. In general from solubility considerations, it is preferred to use for sizing agent at least a half-salt composition; i.e. a composition with at least one metal cation equivalent per molecule of divalent organic anion. The partly salified products may be obtained in several ways. Firstly, they may be obtained by partial salification using less than the full stoichiometric amount of metal cations for the conversion of the anhydride to the fully salified condition. Alternately, the fully salified salt may be produced initially and then converted to a partially salified salt by back reaction with a desired amount of mineral acid such as HCl or $H_2SO_4$. Since the sizing process is preferably conducted at a pH of from about 4 to about 5, it is desirable in some instances to feed a partially salified salt to the sizing operation to avoid the necessity for feeding mineral acid to the sizing operation for pH control.

To produce the R′ groups specified herein, one preferably uses for the reaction with maleic anhydride, thereby characterizing the product, a mixture of predominantly internal olefins having from 16 to about 24 carbon atoms per molecule. The mixture may be obtained by fractionation or by blending of olefins of various types and molecular weights, or, preferably, by the isomerization of corresponding vinyl olefins, vinylidene olefins, internal olefins, or of mixtures of two or more thereof. Typically, the olefins isomerized for reaction with maleic anhydride are a mixture of vinyl, vinylidene and internal types produced by chain growth or polymerization of ethylene with a lower alkyl aluminum compound such as triethyl aluminum.

Olefin mixtures substantially free of vinyl olefins can be obtained from various sources such as the dehydration of alcohols, the dehydrohalogenation of alkyl halides, the dehydrogenation of alkanes, wax cracking, etc. Where available mixtures of olefins contain more than about 10 mol percent of terminal olefins, it is preferred to use an intermediate isomerization step which converts at least a portion of the terminal olefins into internal olefins. Preferably the isomerization is performed with a catalyst which minimizes undesired side reactions. Alternately or additionally, vinyl olefins can be converted via dimerization. For example, a mixture of octene-1 and decene-1 can be subjected to dimerization to produce a mixture containing a high proportion of branched $C_{16}$, $C_{18}$ and $C_{20}$ vinylidene olefins which can be reacted with maleic anhydride either directly or after an intervening isomerization step.

For convenience and simplicity, the structures of various typical substituted succinic acid salts useful in the practice of the present invention are set forth on the basis of starting olefins which are reacted with maleic anhydride to produce them. The saturated radicals may be obtained from the unsaturated substituted succinic anhydride or acid or salt by any suitable procedure such as catalytic hydrogenation using, for example, nickel, platinum or copper chromite catalyst. Typical starting olefins are: straight chain internal olefins such as hexadecene-2, hexadecene-3, hexadecene-4, hexadecene-5, heptadecene-2, heptadecene-3, octadecene-2, octadecene-3, nonadecene-2, nonadecene-3, eicosene-2, eicosene-3, heneicosene-2, heneicosene-3, docosene-2, docosene-4, tricosene-3, tricosene-6, tetracosene-3, pentacosene-6, hexacosene-2, hexacosene-10, and the like. Other typical starting olefins are proximately branched or substituted chain terminal olefins, or vinylidene olefins, such as 2-ethyltetradecene-1, 2-methylhexadecene-1, 2-propyltetradecene-1, 2-butyltetradecene-1, 2-hexyldecene-1, 2-hexyltetradecene-1, 2-decyltetradecene-1, 2-dodecyltetradecene-1, and the like. Other typical olefins are: 2-ethyltetradecene-2, 3-methylheptadecene-3, 2-ethylheptadecene-3, 3-methylheptadecene-2, 3-methyl,-4-ethylheptadecene-3, and the like.

It is evident that the distribution on a molecular weight basis as well as on a structure basis of the various alkenyl groups in the substituted succinic acid salts is readily determined from the molecular weight and structure distributions of the starting olefins reacted with maleic anhydride. Preferred olefin mixtures reacted with maleic anhydride are substantially free of vinyl olefins thus providing a high percentage in the product of alkenyl succinic acid salts whose alkenyl groups contain at least two R groups each. Such compositions have been found to have superior sizing properties in comparison to alkenyl succinic acid salts whose alkenyl groups have only one R group each.

The sizing agents of the present invention generally are more effective than prior art sizing agents, particularly in low alum concentration, providing significant cost reduction. Generally, a given sizing effect can be obtained with smaller quantities of the present sizing agents than with prior art sizing agents. In addition, less precipitating agent is required for a given sizing effect when using the sizing agents of the present invention. In addition to the foregoing, the present sizing agents exhibit synergism when used in combination with conventional rosin sizing agents; viz, a greater sizing effect is obtained in many instances when using ternary systems of alum, rosin size and the substituted succinic acid salt sizing agents of the present invention than is obtained with binary systems of alum plus rosin size or of alum plus the substituted succinic acid salt sizing agents of the present invention. Furthermore, the present sizing agents provide improved retention of filler in many instances wherein it is desired to apply filler to the paper stock. Thus sizing is also performed according to the teachings of the present invention using a ternary system of alum, filler and novel sizing agent of the present invention as well as when using quaternary systems of alum, filler, rosin size and novel sizing agent of the present invention.

Preferably, the sizing is accomplished by treating the paper stock; i.e., the dilute suspension of celulose or other fibers in water, prior to the formation of the paper sheet or web in the "front" or "wet" end of the paper machine. Thus sizing agent is suitably added at one or more of several places, such as the headbox or at the beater or refiner where the stock is prepared for the headbox or at some intermediate point such as a mixing chest, etc.

Typically, pulp sizing agent, precipitating agent, filler where used, and pH control agent where used are brought together at the same point or at different points and in any order or sequence of combination of the various components. Where the white water is recovered after separation thereof from the stock in the paper machine and is recirculated for use in forming additional stock, part of the additives will generally be contained in the recycle stream and hence affect to some extent the apparent sequence of addition. Furthermore, such recycle operation means that the sizing agents used must not have a short effective life otherwise the portion recycled is of limited effectiveness. In this respect, the present sizing agents have excellent characteristics because for all practical purposes they are not limited in regard to effective life as are sizing systems based on alkenyl succinic anhydrides which seek to retain the anhydride state during the sizing operation.

Retention of filler is generally higher with the sizing agents or combinations of the present invention where the sizing agent is added to the stock before the precipitating agent. Thus in many instances where maximum retention of the filler is of importance, such as where at least a significant part of the white water is discarded rather than recycled, it is preferred to use a sequence of addition in which the precipitating agent is added to the mixture of stock and sizing agent.

The proportions of the sizing agents of the present invention are not especially critical; however, important advantages of the present sizing agent are the outstanding effectiveness in regard to both sizing and filler retention attained at low percentages of sizing agent and precipitating agent and the ease with which the sizing agents are used in combination with rosin size. Accordingly, the weight ratio of sizing agent to precipitating agent is from about 0.02 to about 1.0, preferably from about 0.1 to about 0.5. The weight ratio of size to pulp, dry fiber basis, is sufficient to provide at least an effective amount of sizing agent but not an excessive amount. It is from about 0.0005 to about 0.05, preferably from about 0.001 to about 0.01. Where rosin is used in sizing in accordance with the teachings of the present invention, any amount of the substituted succinic acid salt of the present invention is significant because it is effective to provide sizing over that provided by the rosin within the present substituted succinic acid salt. Likewise any amount of rosin is significant because it too provides sizing over that provided by the substituted succinic acid salt of the present invention. Thus the present invention includes the use of sizing agent combinations including both rosin and substituted succinic acid salts of the present invention which meet the overall ratio of sizing agent to pulp previously set forth. In general such sizing agent combinations contain at least about 0.001 percent, preferably at least about 10 percent, now preferably at least 25 percent by weight of the substituted succinic acid salts of the present invention based on the total of said salts plus the rosin.

The sizing agents of the present invention are useful with natural or synthetic fiber pulp of various sources conventionally used in papermaking processes including hardwood pulp, soft wood pulp, synthetic or plastic fibers, and the like. Such pulp may be of the bleached or unbleached sulfate, sulfite, and such types as are used in the paper industry, including reworked paper. Such pulps may be used alone or in various conventional combinations where rosin alone is a useful sizing agent.

EXAMPLES

Paper stock was prepared using a mixture of Northern hardwood bleached kraft pulp and Northern softwood bleached kraft pulp in 70/30 weight ratio. The pulps were beaten separately according to Method T200 OS-70 of the Technical Association of the Pulp and Paper Inudstry (TAPPI). The hardwood pulp was beaten to a Canadian Standard Fineness of about 180 and the softwood pulp to a fineness of about 585 as measured by TAPPI Method T227 M-58. The beaten pulps were then combined in the 70/30 ratio and diluted to 0.4 percent consistency with water. In those examples where filler was used, the filler was added to the pulp at this stage. Except where otherwise specified, the size or sizes were added next using a one gram per liter aqueous solution thereof, followed by the precipitating agent (alum) using a 20 gram per liter aqueous solution thereof. The paper stock was kept in continuous agitation throughout the addition, a five minute stirring period being used prior to each new addition.

Using paper stock with additives added as in the foregoing, paper sheets were formed according to TAPPI Method T218 M-59, except that 1.2 grams of pulp were used in each sheet. The sheets were pressed and dried according to their TAPPI procedure.

The capacity of the paper was measured according to TAPPI Method T425 M-60. The degree of sizing was measured using TAPPI Method T433 M-44. Filler retention was determined by running an ash determination on the paper using TAPPI Method T413 ts-66). The same conditions were used with a known amount of filler to obtain the ignition loss of the filler itself. From this, the actual filler in the sheet was back calculated, and knowing the initial amount of filler used, the percent filler retention was calculated.

For Examples I to VII, XIII to XV, and XXVII–XXXII the water used was a synthetic standard water composition similar to Richmond, Virginia, tap water, obtained by adding all the known ingredients of Richmond tap water to distilled water in the same proportions as their averages in the tap water. The standard water composition for use in comparison of the sizing and filler retention with various materials was prepared by adding per liter of distilled water the following (in milligrams): calcium sulfate 21, calcium chloride 67.7, iron chloride ($FeCl_3$) 0.34, aluminum sulfate 0.27, sodium silicate 13.7, copper sulfate 0.4, magnesium sulfate 10.8. After the addition, the pH was adjusted to 7.0 using HCl.

For Examples VIII–XII and XVII–XXVI the water used was Richmond, Virginia, tap water.

For Example XVI the water used was Baton Rouge, Louisiana well water of the following principal characteristics: pH value at 25° C., 8.9, impurities, parts per million: carbonate ($CO_3^=$) 18, bicarbonate ($HCO_3^-$) 136, chloride ($Cl^-$) 2, sulfate ($SO_4^=$)<5, silica ($SIO_2$) 24, hardness (as $CaCO_3$) 3.3, calcium (Ca) 1.3 calculated, magnesium (Mg)<0.05, sodium (Na) 71, dissolved solids 200, suspended solids<5 est., total solids 240, Iron (Fe)<0.05, manganese (Mg)<0.05, aluminum<0.05, color-APHA units<5.

The rosin size used was fortified rosin (Cyfor III, American Cyanamid). This was a paste emulsion of 77 percent solids, the conventional form in which rosin is used in the paper industry.

EXAMPLE I

Example I shows sizing effect obtained with five different amounts of precipitating agent (alum), by using the foregoing procedure with 0.2 wt. percent (dry fiber basis) of $C_{16-20}$ ASA (alkenyl succinic acid salt) of the formula:

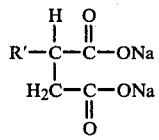

wherein R' has from 16 to about 26 carbon atoms obtained by isomerizing a mixture of vinyl, vinylidene and internal olefins.

The isomerized olefins used for the preparation of the $C_{16-20}$ ASA had a composition of:

Carbon Number Distribution, wt. percent

| | |
|---|---|
| $C_{16}$ | 47.4 |
| $C_{18}$ | 39.5 |
| $C_{20}$ | 13.0 |
| $C_{22}$ | 0.1 |
| | 100.0 |

Type Analysis, mol percent

| | Before Isomerization | After Isomerization |
|---|---|---|
| Vinyl | 61.6 | 1.2 |
| Internal | 13.5 | 71.6 |
| Vinylidene | 24.9 | 0.9 |
| Tri-Substituted | 0 | 26.3 |
| | 100.0 | 100.0 |
| Average Molecular Weight | | 242.0 |
| Average Carbon Atoms per Molecule | | 17.3 |

550 Grams (2.27 mols) of olefin, 223 grams (2.27 mols) of maleic anhydride and 1 gram of 4,4'-methylenebis(2,6-ditertbutylphenol) were charged to a 2-liter stirred autoclave. The autoclave and its contents were then sparged with nitrogen for 20 minutes, pressurized with nitrogen to 200 psig, and then heated to 250° C. The pressure increased to 300 psig on heating.

Samples were withdrawn periodically and analyzed by NMR (nuclear magnetic resonance) and IR (infrared) for completeness of reaction. After about 4.5 hours reaction time the autoclave was cooled and vented to atmospheric pressure. The product was then heated at 205° C. and 0.5 mm Hg pressure to remove unreacted olefin and maleic anhydride. Analysis of a sample of the stripped product indicated an acid value of 305 milligrams KOH per gram and an average molecular weight of 368.

A 150 gram (0.408 mol) portion of the stripped product was placed in 700 ml of water and reacted for several hours with 3.2 grams of NaOH (0.0816 mols) in 250 ml of water at 80°–90° C. to produce the fully salified di-sodium salt. The pH of the resulting salt was 8.0 (concentrated) and 8.3 when a portion was diluted to about 2 percent solution. A small additional amount of the stripped product was then added to the di-salt to lower the pH thereof to 8.28 (concentrated) and 8.05 in dilute (2 percent) solution.

A 100.9 gram sample of sodium salt solution thus obtained was acidified with excess dilute HCl (6 N) to a pH of about 1 and extracted with ether to remove the dicarboxylic acid. The ether extract was dried with calcium sulfate, and then the ether was removed by evaporation to dryness in a rotary evaporator at 50° C. and reduced pressure to give a residue of 12.0 grams of diacid. Thus the concentration of the salt solution was 11.9 wt. percent as equivalent diacid. Size times were then determined in the procedure outlined under the heading "Examples" using the $C_{16-20}$ ASA thus obtained, using synthetic tap water. Results are shown in Table I. Excellent sizing is indicated over a wide range of concentration of alum. Particularly significant are the high size levels 4n the region of 40 to 50 obtained even at the low alum concentrations.

EXAMPLE II

Example II is a comparative example using the same sizing test procedure as in Example I but substituting a conventional fortified rosin size for the $C_{16-20}$ ASA size used in Example I. Data are presented in Table I. In comparison to the data of Example I, it is evident that the sizing obtained with the $C_{16-20}$ ASA of Example I is much superior to that obtained with the fortified rosin size.

The fortified rosin size using this Example II was American Cyanamid Cyfor III.

EXAMPLES III AND III-A

Example III is another comparative example following the procedure of Example I but using 0.2 wt. percent of a di-sodium salt of branched dodecenyl succinic acid (branched $C_{12}$ ASA) obtained by reacting tetrapropylene with maleic anhydride using a procedure similar to that of Example I. Results tabulated in Table I show the superiority of the present $C_{16-20}$ ASA compositions.

Example III-A is another comparative example using secondary $C_{12}$ ASA di-sodium salt obtained by reacting a mixture of 12 percent n-dodecene and 88 percent isomeric secondary dodecenes with maleic anhydride as described in Example I. Results are shown in Table I. The superiority of the $C_{16-20}$ ASA is evident particularly at the lower alum levels.

EXAMPLE IV

Example IV is a comparative example using the procedure of Example I but with 0.2 wt. percent of the di-sodium salt of normal dodecenyl succinic acid (N-$C_{12}$ ASA). This was obtained by reacting dodecene with maleic anhydride following the procedure as described in Example I. Results tabulated in Table I show that this material provides better sizing than the predominantly secondary ($C_{12}$ ASA) salt of Example III-A; however, almost twice as much alum is required to provide sizing times comparable to those obtained with the ($C_{16-20}$ ASA) of Example I.

EXAMPLES V–VII

For Example V the sizing test procedure of Example I was repeated; however, only 0.12 wt. percent of the present typical size ($C_{16-20}$ ASA) was used. The sizing results are given in Table II which also inclues comparative sizing data taken when using 0.12 percent of rosin size (Example VI) and 0.12 percent of (N-$C_{12}$ ASA) di-sodium salt (Example VII). It is seen that the compositions of the present invention provide sizing which is superior to that obtained with the rosin size at all levels of alum and superior to the (N-$C_{12}$ ASA) at the lower alum levels.

EXAMPLES VIII–XII

Examples VII–XII show that the typical ($C_{16-20}$ ASA) size of the present invention can be combined effectively with rosin size, even at low alum levels, to provide a novel combined size system, process and product. Filler ($TiO_2$, 10 wt. percent, dry fiber basis) was used in this series to show the enhancement of filler retention resulting from the use of the typical ($C_{16-20}$ ASA) size. Size data using the forgoing procedure are shown in Table III followed by numbers in brackets [] which indicate percent capacity which is indicative of filler retention. Significant comparisons indicate that at the 0.5 percent alum level a superior sizing time of 19 seconds is obtained with 0.24 percent sizing agent total using a mixture of 0.12 percent fortified rosin size and 0.12 percent of the present typical ($C_{16-20}$ ASA) size. This compares to a size time of 11 seconds obtained with each sizing agent alone at the 0.24 percent size level. Synergism is also shown at the 1.5 percent alum level.

EXAMPLES XIII–XV

These examples also show the effect of the present sizing agents upon the retention of filler ($TiO_2$) during the papermaking operation. The amount of $TiO_2$ used was 10 percent by weight, dry fiber basis, in all cases. Data are shown in Table IV. Example XIII used the present typical ($C_{16-20}$ ASA) size at the 0.12 percent level and indicates actual filler losses are less than those experienced when using fortified rosin size at the 0.12 percent level (Example XIV). The amount of filler retained is even higher for Example XV where 0.2 percent of the typical ($C_{16-20}$ ASA) size was used.

EXAMPLE XVI

Example I was repeated with 0.5 percent alum (wt. percent dry fiber basis) and 5 percent $TiO_2$ filler (wt. percent, dry fiber basis) using Baton Rouge, Louisiana well water at a sizing system pH of 7.6, partial acidification of the water being obtained from the alum. This water was described under the general heading of "Examples". The sizing time obtained was 8 seconds and the opacity was 79.1 percent. In comparison runs of this example, the water was adjusted with HCl to a pH of 4.5 prior to use. With this change the size time increased to 42 seconds and the opacity increased to 85.9 percent. Thus, it is seen that especially with control of pH, the pesent sizing agents provide high size times and high opacity even with comparatively low alum levels of 0.5 percent, providing a considerable economic advantage over systems that require higher alum levels.

EXAMPLE XVII

The procedure set forth under "Examples" was repeated for 0.12 percent of the typical ($C_{16-20}$ ASA) sizing agent using Richmond, Virginia, tap water, 5 percent $TiO_2$ filler and 0.5 percent alum. Filler retention was 89.4 percent.

EXAMPLE XVIII

Example XVII was repeated using 0.12 percent fortified rosin size for comparison with the results of Example XVII. Filler retention was 83.7 percent.

EXAMPLE XIX

Example XVII was repeated using 0.2 percent of present $C_{16-20}$ ASA sizing agent. Size time was 32 seconds.

EXAMPLE XX

Example XIX was repeated using 0.2 percent rosin size for comparison with the results of Example XIX. Size time was 15 seconds, noticeably lower.

EXAMPLE XXI

Example XIX was repeated using 0.12 percent of the typical ($C_{16-20}$ ASA) sizing agent. The pH of the pulp-size slurry system was adjusted to 4.5 after all the components were combined but prior to formation of the sheet. Size time was 51 seconds.

EXAMPLE XXII

Example XXI was repeated using 0.12 percent of fortified rosin size for comparison to the results of Example XXI. Size time was 34 seconds. Both Examples XXI and XXII showed significant improvement over Examples XIX and XX resulting from control of pH; however, the superior sizing provided by the typical ($C_{16-20}$ ASA) size is evident in both comparisons.

EXAMPLE XXIII

Example XXI was repeated using 0.2 percent of the typical ($C_{16-20}$ ASA) sizing agent. Filler retention was 89.4 percent.

EXAMPLE XXIV

Example XXIII was repeated using 0.2 percent of fortified rosin size for comparison to the results of Example XXIII. Filler retention was 86.3 percent.

EXAMPLE XXV

Example XVII was repeated with 0.12 percent of the typical ($C_{16-20}$ ASA) sizing agent; however, a different sequence of addition of the materials was used. In this example, the alum was added prior to the addition of the sizing agent. Size time was 21 seconds.

EXAMPLE XXVI

Example XXV was repeated using 0.12 percent of fortified rosin size for comparison to the results of Example XXV with the reverse order of addition; viz, adding alum before adding the size. Size time was 4 seconds. Thus the composition of the present invention is shown as providing superior sizing with a sequence involved in the recirculation of paper machine "white" water.

EXAMPLES XXVII–XXIX

The procedure set forth under "Examples" was repeated using synthetic tap water, 5 percent $TiO_2$, 1.5 percent alum and various amounts of a different typical sizing agent of the present invention a ($C_{18}$+ ASA) di-sodium salt (Example XXVII), of the typical ($C_{16-20}$ ASA) di-sodium salt or the present invention (Example XXVIII) and of a (N-$C_{16-20}$ ASA) di-sodium salt (R′ being RCH=CH-$CH_2$-) of approximately the same weight percent distribution of alkenyl groups of various carbon numbers as in the olefins used in Example I but which has only one R group in the substitution portion R′ of the molecule. The (N-$C_{16-20}$ ASA) salt is not within the scope of the present claims. All of the ASA materials were fed in the form of the di-sodium salt.

The typical ($C_{18}$+ ASA) was prepared as a di-sodium salt of the substituted succinic acid using the procedure set forth in Example I for the typical ($C_{16-20}$ ASA) salt; however, olefins of the (different) composition shown hereinafter were used for reaction with maleic anhydride thereby providing a different average of the substitution radicals R′ which is of considerably higher average total atomic weight than that present in the typical ($C_{16-20}$ ASA) size. It is evident that the typical $C_{18}$+ ASA) size of the present invention also provides improved results over the (N-$C_{16-20}$ ASA) size despite the higher average molecular weight.

| Olefin Carbon Atoms per Molecule | Wt. Percent |
|---|---|
| 16 and below | 1.7 |
| 18 | 6.3 |
| 20 | 54.0 |
| 22 | 26.9 |
| 24 | 9.4 |
| 26 | 1.7 |
| | 100.0 |

| Average Molecular Weight | 302 |
|---|---|
| Olefin Type | Mol Percent |
| Vinyl | 1.5 |
| Internal | 54.6 |
| Vinylidene | 1.8 |
| Trisubstituted | 42.1 |
| | 100.0 |

604 Grams (2.0 mols) of olefin, 196 grams (2.0 mols) of maleic anhydride and 1.5 gram of 4,4′-methylenebis(2,6-ditert-butylphenol) were charged to the 2 liter stirred autoclave. The reaction time was 4.3 hours. The addition product was stripped and analyzed by NMR, IR and wet chemical analysis techniques to give similar results except an acid number of 257 and a corresponding apparent molecular weight of about 354.

The "complete" salification was carried out as with the typical ($C_{16-20}$ ASA) sample using 354 grams (1 mol) of the $C_{18}$+ ASA and 81.5 grams (2 mols) of NaOH. In this instance more ASA addition product had to be added to bring the pH of the salt solution down to 8.5. The total volume of water was increased to 3.5 liters because of low solubility. This volume was evaporated to about 2.5 liters and a 103.4 gram portion acidified, extracted and evaporated as in the preparation of the $C_{16-20}$ ASA to give a residue of 21.4 grams of diacid. Thus the concentration of the salt solution 2.5 liters was 20.7 wt. percent as equivalent diacid.

Size time data are given in Table VI. It is evident that the sizing times of Examples XXVII and XXVIII are longer to the sizing time of Example XXIX.

EXAMPLES XXX–XXXII

The procedure of Example XXI was repeated in a series of runs comparing the amount of typical ($C_{16-20}$ ASA) sizing agent and of fortified rosin required at alum levels of 1.0 percent and 2.0 percent to provide typical size times in the region of 10–20 seconds. Results are tabulated in Table VII, wherein all percents and ratios shown are by weight based on dry fiber. These examples show that, in their ranges, from about 1.5 to about 1.8 times as much rosin is required to provide size times equivalent to those obtained with the typical ($C_{16-20}$ ASA) size of the present invention.

TABLE I

| % Alum Dry Fiber Basis | Size Time (Seconds) Examples I 0.2% of $C_{16-20}$ ASA | II 0.2% of Fortified Rosin Size | III 0.2% of Branched $C_{12}$ ASA | III-A 0.2% Secondary $C_{12}$ ASA | IV 0.2% of N—$C_{12}$ ASA |
|---|---|---|---|---|---|
| 0.5 | 41 | 14 | — | — | — |
| 0.8 | — | — | — | 18 | 16 |
| 1.0 | 53 | 17 | 9 | — | — |
| 1.2 | — | — | — | 26 | 33 |
| 1.5 | 51 | 24 | 10 | — | — |
| 1.7 | — | — | — | 35 | 35 |
| 2.0 | 49 | 19 | 11 | 41 | 47 |
| 2.5 | — | — | 11 | 53 | 54 |
| 3.0 | 50 | 28 | 10 | 50 | 61 |
| 3.5 | — | — | 11 | — | — |

TABLE II

| % Alum Dry Fiber Basis | Size Time (seconds) Examples V 0.12% of $C_{16-20}$ ASA | VI 0.12% of Rosin Size | VII 0.12% of N—$C_{12}$ ASA |
|---|---|---|---|
| 0.5 | 11 | 4 | — |
| 0.8 | — | — | 13 |
| 1.0 | 18 | 7 | — |
| 1.2 | — | — | 15 |
| 1.5 | 21 | 7 | — |
| 2.0 | 13 | 7 | 38 |
| 2.5 | — | — | 32 |
| 3.0 | 20 | 10 | 40 |

TABLE III

| % Alum Dry Fiber Basis | Size Time (Seconds) - Opacity (%) Examples VIII 0.12% of $C_{16-20}$ ASA + 10% $TiO_2$ | IX 0.12% of Rosin Size + 10% $TiO_2$ | X 0.24% $C_{16-20}$ ASA + 10% $TiO_2$ | XI 0.24% of Rosin Size + 10% $TiO_2$ | XII 0.12% $C_{16-20}$ ASA + 0.12% Rosin Size + 10% $TiO_2$ |
|---|---|---|---|---|---|
| 0.5 | 6[90.4] | 6[87.1] | 11[89.8] | 11[89.2] | 19[89.2] |
| 1.5 | 16[89.3] | 39[92.7] | 42[89.8] | 47[90.5] | 50[90.8] |

[ ] = percent opacity

TABLE IV

| % Alum Dry Fiber Basis | Filler Loss Percent of Applied $TiO_2$ Lost Examples XIII 0.12% of $C_{12-20}$ ASA | XIV 0.12% of Rosin Size | XV 0.2% of $C_{16-20}$ ASA |
|---|---|---|---|
| 0.5 | 32 | 44 | 13 |
| 1.0 | 16 | 53 | 8 |
| 1.5 | 12 | 42 | 11 |
| 2.0 | 13 | 36 | — |
| 2.5 | — | — | — |
| 3.0 | 12 | 28 | 11 |

TABLE V

| Example | Wt. % of Size | Size Time (Seconds) | Opacity % |
|---|---|---|---|
| XVII | 0.12% $C_{16-20}$ ASA | | 89.4 |

TABLE V-continued

| Example | Wt. % of Size | Size Time (Seconds) | Opacity % |
|---|---|---|---|
| XVIII | 0.12% Rosin Size | | 83.7 |
| XIX | 0.20% $C_{16-20}$ ASA | 32 | |
| XX | 0.20% Rosin Size | 15 | |
| XXI | 0.12% $C_{16-20}$ ASA | 51 | |
| XXII | 0.12% Rosin Size | 34 | |
| XXIII | 0.2% $C_{16-20}$ ASA | | 89.4 |
| XXIV | 0.2% Rosin Size | | 86.3 |
| XXV | 0.12% $C_{16-20}$ ASA | 21 | |
| XXVI | 0.12% Rosin Size | 4 | |

TABLE VI

| % ASA Dry Fiber XXVII Basis | Size Time (Seconds) XXVIII $C_{16+}$ ASA | Example-Normal $C_{16-20}$ ASA | XXIX $C_{16-20}$ ASA |
|---|---|---|---|
| 0.05 | 1 | 6 | 1 |
| 0.10 | 3 | 14 | 3 |
| 0.15 | 17 | 34 | 8 |
| 0.20 | 38 | 43 | 17 |
| 0.25 | 37 | 49 | 22 |

TABLE VIII

| Size Time (Seconds) | Examples XXX $C_{16-20}$ ASA (%) | XXXI Rosin (%) | XXXII Ratio (Rosin/$C_{20-20}$ ASA) |
|---|---|---|---|
| | Alum Level 1.0% | | |
| 10 | 0.07 | 0.13 | 1.8 |
| 15 | 0.08 | 0.14 | 1.8 |
| 20 | 0.09 | 0.15 | 1.7 |
| | Alum Level 2.0% | | |
| 15 | 0.06 | 0.09 | 1.5 |
| 20 | 0.075 | 0.12 | 1.6 |

We claim:

1. The method of sizing paper which comprises the step of intimately dispersing within the wet pulp prior to the ultimate conversion of said pulp into a dry web as a sizing agent an effective amount of a system of alum plus alkali metal salt of substituted dicarboxylic acid corresponding to the structural formula

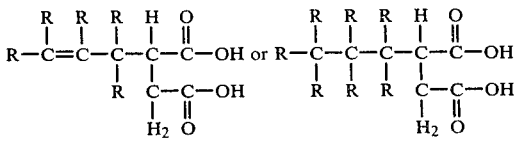

wherein R is hydrogen or alkyl, at least two R groups being alkyl, and the total number of carbon atoms in the salt is from 20 to about 30, and wherein the amount of alum is up to about 1.7% by weight on a dry fiber basis and in an amount sufficient to provide superior sizing properties in comparison with succinic acid salts of said formula wherein the total number of carbon atoms in R′ is less than 16.

2. The method of claim 1, wherein the salt is alkali metal salt.

3. The method of claim 1, wherein the salt is sodium salt.

4. The method of claim 2, wherein alkyl groups of R are essentially straight chain groups.

5. The method of claim 3, wherein rosin size is also intimately dispersed within the wet pulp prior to the ultimate conversion of said pulp into a dry web, the weight ratio of said rosin size to said salt is from about 0.1 to about 10, and the weight ratio of said rosin size plus said salt to said alum is from about 0.2 to about 1.0.

6. A process according to claim 1, wherein the weight ratio of said sizing agent to said precipitating agent is from about 0.02 to about 1.0.

7. A process according to claim 1, wherein the weight ratio of said sizing agent to said precipitating agent is from about 0.1 to about 0.5.

8. A process according to claim 1, wherein the aqueous suspension of paper pulp is also admixed with filler.

9. A process according to claim 1, wherein the filler is titanium dioxide.

10. A process according to claim 1, wherein rosin size is also incorporated therein and the weight ratio of said rosin size to said salt is from about 10:1 to about 1:10.

11. A process according to claim 1, wherein water soluble salt is a mixture of salts having at least two different numbers of carbon atoms per molecule, there being present in the mixture at least 10 percent of salt of each of two different numbers of carbon atoms per molecule.

12. A process according to claim 1, wherein the pH of said mass is from about 4 to about 6 when the paper sheet is formed.

13. The process of claim 1, wherein the pH is adjusted to form about 4 to about 6 by the addition of a mineral acid.

14. The process of claim 1, wherein the mineral acid is HCl.

15. The process of claim 1, wherein the mineral acid is $H_2SO_4$.

16. A sized paper comprising a fibrous cellulosic web which has been internally sized with a water soluble salt of substituted succinic acid having the formula

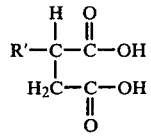

wherein R′ is a hydrocarbon group of the formula

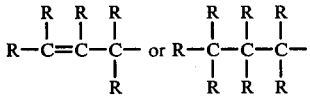

wherein R is hydrogen or alkyl, at least two R groups being alkyl, and the total number of carbon atoms in R′ is from 16 to about 26, and with alum, said alum being in an amount up to about 1.7% by weight on a dry fiber basis and in an amount sufficient to provide superior sizing properties in comparison with succinic acid salts of said formula wherein the total number of carbon atoms in R′ is less than 16.

* * * * *

UNITED STATES PATENT AND TRADEMARK OFFICE

CERTIFICATE OF CORRECTION

PATENT NO. : 4,302,283

DATED : November 24, 1981

INVENTOR(S) : Sidney M. Blitzer and Harry D. Wilder

It is certified that error appears in the above—identified patent and that said Letters Patent is hereby corrected as shown below:

Column 2, line 48, reads "cinic acid salt sizing agent. Especially preferred precipi-", should read --cinic acid salt sizing agent.--

Column 2, line 49, reads "tation agent salt sizing agent. Especially preferred pre-", should read -- Especially preferred pre- --

Column 4, lines 55-60, reads as follows:

```
  R R R
R-C-C-C-
      R
```

and should read as follows:

```
  R R R
R-C=C-C-
      R
```

Column 9, line 28, reads "their TAPPI", should read --this TAPPI--

Column 10, line 61, reads "3.2 grams", should read --33.2 grams--

Column 11, line 15, reads "levels 4n the", should read --levels in the--

Column 11, line 27, reads "using this", should read --used in this--

Column 12, line 14, reads "capacity", should read --opacity--

Column 14, line 12, reads "cal $C_{18+}$ ASA)", should read --cal ($C_{18+}$ASA)--

UNITED STATES PATENT AND TRADEMARK OFFICE

CERTIFICATE OF CORRECTION

PATENT NO. : 4,302,283

DATED : November 24, 1981

INVENTOR(S) : Sidney M. Blitzer and Harry D. Wilder

It is certified that error appears in the above—identified patent and that said Letters Patent is hereby corrected as shown below:

Column 15, line 56, reads "$C_{12-20}$ ASA", should read --$C_{16-20}$ ASA--

Column 16, lines 17-20, the headings for Table VI should be as follows:

| % ASA Dry Fiber Basis | Examples XXVII $C_{18+}$ ASA | XXVIII $C_{11-20}$ ASA | XXIX Normal $C_{16-20}$ ASA |
|---|---|---|---|

Column 16, lines 51 and 52 are part of Table VII

Under ABSTRACT, line 2, text reads "substitutes", should read --substituted--

Signed and Sealed this

*Twenty-fifth* Day of *May 1982*

[SEAL]

*Attest:*

GERALD J. MOSSINGHOFF

*Attesting Officer*

*Commissioner of Patents and Trademarks*